US005161796A

United States Patent [19]

Okamoto

[11] Patent Number: 5,161,796

[45] Date of Patent: Nov. 10, 1992

[54] TRANSFER PAPER SEPARATING DEVICE

[75] Inventor: Sueaki Okamoto, Kyoto, Japan

[73] Assignee: Mita Industrial Co., Ltd., Osaka, Japan

[21] Appl. No.: 719,874

[22] Filed: Jun. 24, 1991

[30] Foreign Application Priority Data

Jul. 2, 1990 [JP] Japan ..... 2-175594
Jul. 2, 1990 [JP] Japan ..... 2-175595

[51] Int. Cl.[5] ..... B65H 29/54
[52] U.S. Cl. ..... 271/308; 271/900
[58] Field of Search ..... 271/303, 306-308, 271/312, 314, 900

[56] References Cited

U.S. PATENT DOCUMENTS

| | | | |
|---|---|---|---|
| 4,252,310 | 2/1981 | Kono et al. | 271/308 |
| 4,401,382 | 8/1983 | Minejima et al. | 271/900 |
| 4,748,473 | 5/1988 | Tsuruoka | 271/900 |
| 4,893,146 | 1/1990 | Tachibana et al. | 271/900 |
| 4,929,983 | 5/1990 | Barton et al. | 271/900 |
| 4,951,936 | 8/1990 | Taniyama | 271/308 |

OTHER PUBLICATIONS

Froula, J. D. "Mechanical Stripper with Drum Stop"

*IBM Technical Disclosure Bulletin*, vol. 19, No. 5, pp. 1595-1596, Oct. 1976.

*Primary Examiner*—Robert P. Olszewski
*Assistant Examiner*—Steven M. Reiss
*Attorney, Agent, or Firm*—Jordan and Hamburg

[57] ABSTRACT

A transfer paper separating device for use in an image forming apparatus includes a separating claw for forcibly separating transfer paper passed through an image transfer process from a surface of a photosensitive drum. The separating claw is supported to a supporting shaft in such a manner to naturally rotate about the supporting shaft due to unbalanced weight, with the result that a tip of the separating claw is in contact with the drum surface.In addition, the separating claw is held in a position where the tip thereof is away from the drum surface by a guide member coaxially supported to the supporting shaft therewith. The separating claw and the guide member are respectively supported to the supporting shaft radially removably. Moreover, one side of the separating claw is in contact with the guide member, and the separating claw is thereby prevented from moving in one axial direction of the supporting shaft.

9 Claims, 5 Drawing Sheets

TRANSFER PAPER SEPARATING DEVICE

BACKGROUND OF THE INVENTION AND PRIOR ART STATEMENT

The present invention relates to a transfer paper separating device for use in an image forming apparatus, such as a copying machine, for forcibly separating transfer paper passed through an image transfer process from a surface of a photosensitive drum.

A generally known transfer paper separating device is provided with a separating claw always in contact with the surface of a photosensitive drum for separating transfer paper passed through the image transfer process from the drum surface.

Further, in such a transfer paper separating device, the separated transfer paper is likely to press the separating claw against the surface of the photosensitive drum, which consequently damages the drum surface. Also, the separated transfer paper is likely to be rolled up to more downstream of the drum surface. In order to prevent such likelihoods, a guide member is provided near the separating claw for guiding the separated transfer paper to a transport path right after the transfer paper is separated by the separating claw.

Conventionally, to support a separating claw and a guide member, it has been known that the separating claw and the guide member are attached to a common supporting shaft with juxtaposed with each other in an axial direction thereof.

In this common shaft supporting, there have been known the following two methods:

1) A constant contact method in which the tip of a separating claw is constantly in contact with a surface of a photosensitive drum; and 2) A pivotal method in which a separating claw is pivoted by a solenoid or other actuator integrally with the supporting shaft or independently thereof between an operative position in which the tip of the separating claw is in contact with a surface of a photosensitive drum and an inoperative position in which the tip of the separating claw is away from the drum surface.

However, according to the constant contact method, the tip of the separating claw is constantly pressed against the drum surface, thereby causing a large load on the drum surface in the long run. Further, the tip of the separating claw is more liable to be worn, shortening the replacement cycle of separating claws.

On the contrary, according to the pivotal method, the separating claw is away from the drum surface other than the time when necessary, such as when it is necessary to separate transfer paper. Accordingly, the load on the drum surface can be reduced. However, it is necessary to provide a mechanism for pivoting the separating claw. Further, it is very difficult to accurately regulate the separating claw pivoting mechanism so that the tip of the separating claw comes into contact with the drum surface with an appropriate pressure in the operative position. Accordingly, it is unavoidable that the tip of the separating claw comes into contact with the drum surface with exceedingly large pressure, causing a greater damage to the drum surface than the constant contact method.

In the common shaft supporting, further, the separating claw is slid from one end of the supporting shaft and fixedly attached to the supporting shaft by providing fixing members, such as E-rings, on both sides of the separating claw. Accordingly, it has been cumbersome to attach a separating claw to the supporting shaft.

Further, when an old separating claw is replaced with a new one due to wear in the tip of the old separating claw or other cause, the following three steps have caused an inefficient replacement of separating claws:

1) The supporting shaft is required to be dismounted from the transfer paper separating device to detach the old separating claw from the supporting shaft;

2) The fixing members are required to be removed from the supporting shaft to detach the old separating claw from the supporting shaft; and 3) The guide member stands as an obstacle when the old separating claw is detached.

SUMMARY OF THE INVENTION

Accordingly, it is an object of the present invention to provide a transfer paper separating device which has overcome the above-mentioned drawbacks.

A transfer paper separating device of the present invention comprises a common supporting shaft, a separating claw for separating transfer paper passed through an image transfer process from a surface of a photosensitive drum, a guide member for guiding the transfer paper separated by the separating claw to a predetermined path, guide member pivoting means for pivoting the guide member between a first position and a second position, the separating claw and the guide member being attached to the common supporting shaft with juxtaposed with each other in an axial direction of the common supporting shaft, the separating claw being pivotable about the common supporting shaft between an operative position in which a tip of the separating claw is in contact with the surface of the photosensitive drum and an inoperative position in which the tip of the separating claw is away from the surface of the photosensitive drum, the separating claw being given a tendency of pivoting to the operative position without being controlled, and the guide member being provided with controlling means for preventing the separating claw from pivoting to the operative position when the guide member is in the first position, and allowing the separating claw to pivot to the operative position when the guide member is in the second position.

With this construction, the separating claw is put in the inoperative position in which its tip is away from the surface of the photosensitive drum, when not required. Accordingly, the load applied to the drum surface can be reduced to a great extent. Also, the separating claw pivots to the operative position without any additional force. Accordingly, the separating claw can come into contact with the drum surface at a proper pressure.

Also, the guide member has the two functions of guiding separated transfer paper and controlling the pivoting movement of the separating claw. Accordingly, compared to the conventional device provided with an actuator for actuating a separating claw exclusively, the transfer paper separating device of the present invention is greatly simpler in construction.

Also, the guide member may be supported to the supporting shaft in such a manner as to pivot integrally with the supporting shaft, and the guide member pivoting means pivots the guide member between the first position and the second position by rotating the common supporting shaft.

With this construction, the guide member pivoting means can be desirably provided at an appropriate position in a range of the entire length of the common supporting shaft, depending on spaces between parts or assembling of parts.

Further, a transfer paper separating device of the present invention comprises a common supporting shaft, a separating claw for separating transfer paper passed through an image transfer process from a surface of a photosenstivie drum, the separating claw having a fitting portion formed with an opening for enabling the separating claw to be removably attached to the common supporting shaft in a radial direction of the common supporting shaft, a guide member for guiding the transfer paper separated by the separating claw to a predetermined path, the guide member having a fitting portion formed with an opening for enabling the guide member to be removably attached to the common supporting shaft in a radial direction of the common supporting shaft, fixing means for fixing the guide member on the common supporting shaft, and the separating claw being attached to the common supporting shaft with being made in contact with the guide member so as to keep the separating claw from moving in the axial direction to the guide member.

With this construction, the separating claw and the guide member are removably attached to the common supporting shaft in a radial direction of the common supporting shaft. Accordingly, when the separating claw is replaced, the separating claw and the guide member can be easily detached, and it is not necessary to dismount the common supporting shaft from the device body. Also, the guide member serves as a fixing member for keeping the separating claw from moving in the axial direction. Accordingly, it is not necessary to additionally attach a fixing member on the common supporting shaft. For these reasons, attachment and replacement of a separating claw can be accomplished with more ease.

Also, a fixing member may be attached to the common supporting shaft for keeping the separating claw from moving in the opposite direction to the guide member.

Further, the fitting portion of the separating claw may be slidable on the common supporting shaft, whereby the separating claw is mounted on the common supporting shaft and slid to the fixing member, and the guide member is thereafter fixedly attached to the common supporting shaft by the fixing means.

With this construction, the attachment of the separating claw and the guide member is carried out more easily and smoothly. Also, the separating claw can be attached to the common supporting shaft more firmly.

Further, the fixing means may be constructed by forming a guide member supporting portion in the common supporting shaft for supporting the guide member, the guide member supporting portion having a D-shaped cross section, and forming the fitting portion of the guide member into such a cross section as to be resiliently tightly fittable on the guide member supporting portion.

With this construction, when the guide member is attached to the common supporting shaft, the guide member is fixedly positioned with respect to circumferential and radial directions of the common supporting shaft as well as the axial direction thereof. Accordingly, this construction needs no fixing members, for example a screw, for keeping the guide member from moving in the circumferential and radial directions. Thus, this construction provides easier replacement of separating claws and reduce the number of parts.

Further, the fitting portion of the guide member may be constructed by a flat portion and an arcuate portion, the arcuate portion being formed with a bent portion in an end thereof.

With this construction, the guide member can be attached to the common supporting shaft more easily and firmly.

Further, guide member pivoting means for pivoting the guide member between a first position and a second position may be provided, and the separating claw may be made to be pivotable about the common supporting shaft between an operative position in which a tip of the separating claw is in contact with the surface of the photosensitive drum and an inoperative position in which the tip of the separating claw is away from the surface of the photosensitive drum, the separating claw being given a tendency of pivoting to the operative position without being controlled, and the guide member is provided with controlling means for preventing the separating claw from pivoting to the operative position when the guide member is in the first position, and allowing the separating claw to pivot to the operative position when the guide member is in the second position.

With this construction, the guide member serves the two functions of guiding separated transfer paper and controlling the pivoting movement of the separating claw. Accordingly, this construction can further reduce the number of parts for the device.

These and other objects, features and advantages of the present invention will become more apparent upon a reading of the following detailed description and accompanying drawings.

DETAILED DESCRIPTION OF PREFERRED EMBODIMENT OF THE INVENTION

Figure 1:
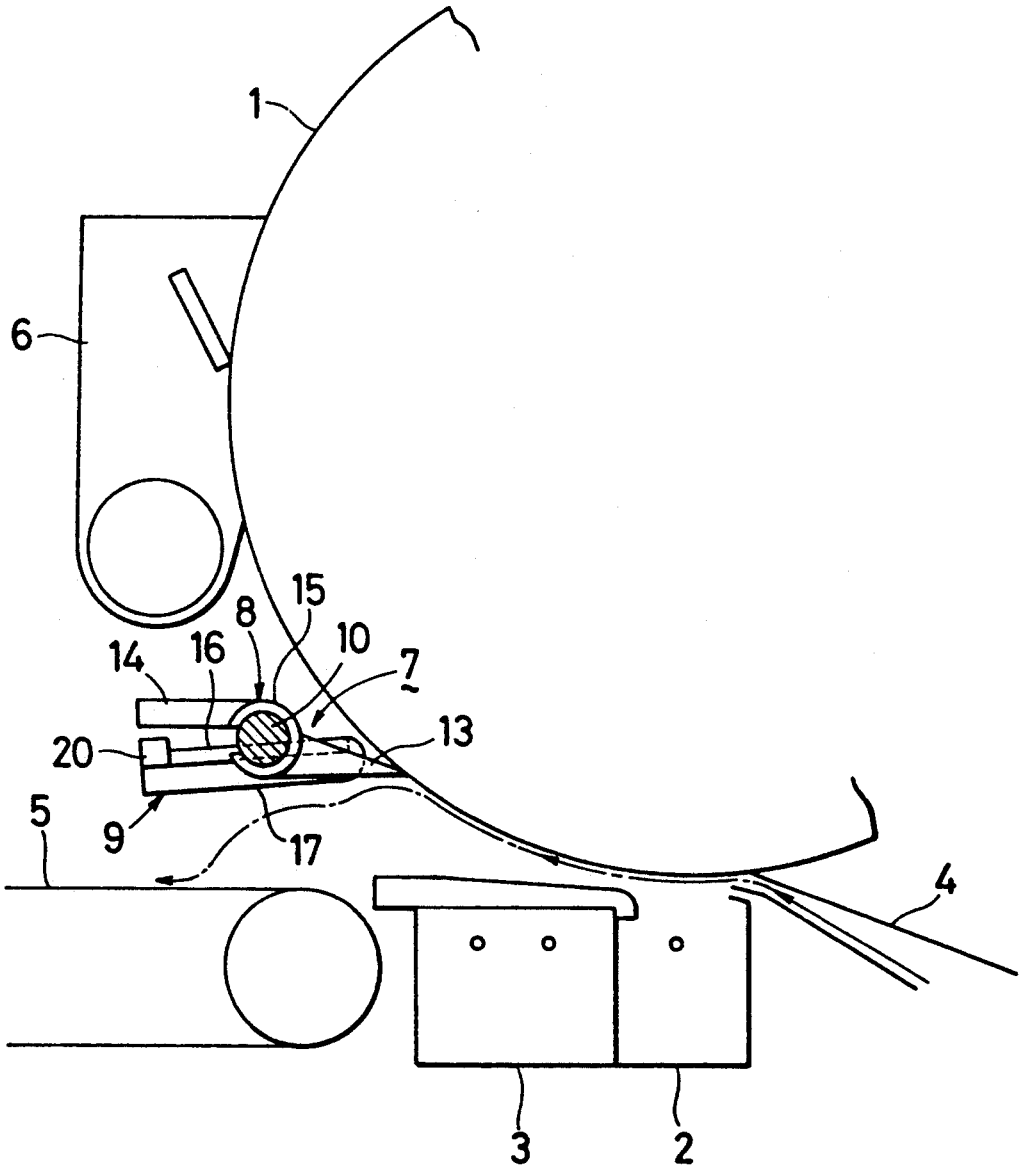
FIG. 1 is a diagram showing a transfer paper separating device embodying the present invention and peripheral devices provided around the transfer paper separating device.

In FIG. 1, indicated at 1 is a photosensitive drum, at 2 is a transfer charger disposed with facing the photosensitive drum 1, and at 3 is a separation charger. The transfer charger 2 is adapted for establishing such an electric field between the photosensitive drum 1 and the transfer charger as to enable a toner image to be transferred to the transfer paper. The separation charger 3 is adapted for establishing such an electric field between the photosensitive drum 1 and the separation charger 3 as to facilitate the separation of the transfer paper from the photosensitive drum 1.

Here, it should be noted that the transfer paper is used as a generic term for any paper to which a toner image can be transferred. The transfer paper is fed through a guide plate 4 to the transfer charger 2, where a toner image on the photosensitive drum 1 is transferred to the transfer paper. Then, the transfer paper is separated from the drum surface in the separation charger 3 and fed to a conveyor belt 5 bound for a fixing unit.

During the above process, there are times when the transfer paper cannot be separated from the drum surface smoothly and conveyed along the drum surface as far as a cleaning device 6 disposed above the conveyor belt 5. Accordingly, a transfer paper separating device 7 is disposed downstream of the separation charger 3 in order to assure the separation.

The transfer paper separating device 7 comprises a sharp-tipped separating claw 8 for forcibly separating the transfer paper from the drum surface and a guide member 9 for immediately directing the transfer paper separated by the separating claw 3 toward the conveyor belt 5. The separating claw 8 and the guide member 9 are coaxially supported on a supporting shaft 10 with axially juxtaposed with each other.

Figure 2:
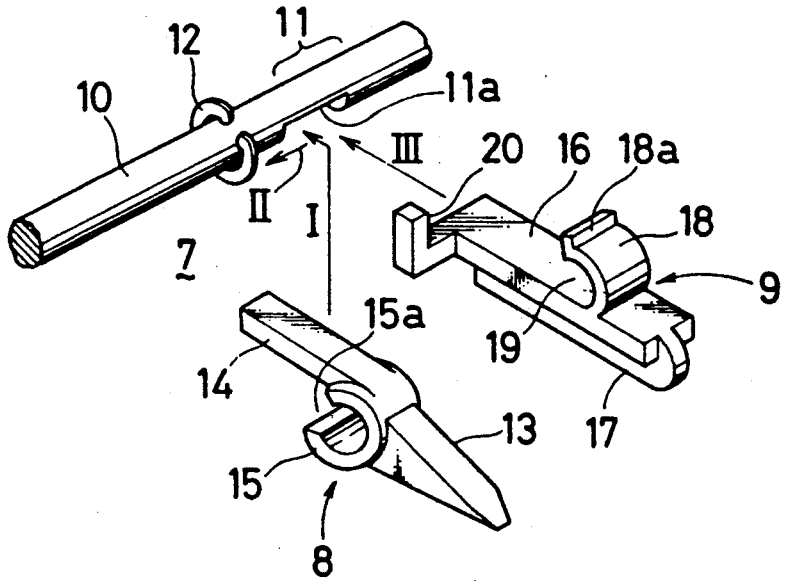
FIG. 2 is a perspective view showing the exploded transfer paper separating device.

The construction of the separating claw 8 and the guide member 9 will be described with reference to FIGS. 2 and 3.

The supporting shaft 10 comprises a guide member supporting portion 11 having a D-shaped cross section and a flat cut surface 11*a* on the bottom thereof. Also, an E-ring 12 is supported on the supporting shaft 10 to the left of the guide member supporting portion 11. The distance between the E-ring 12 and the guide member supporting portion 11 corresponds to the width of the separating claw 8. The E-ring 12 serves as a fixing member for keeping the separating claw 8 from sliding in an axial direction of the supporting shaft 10.

The separating claw 8 comprises a sharp-tipped claw portion 13, a lever portion 14, and a fitting portion 15 disposed between the claw portion 13 and the lever portion 14. The separating claw 8 is attached to the supporting shaft 10 with the fitting portion 15 fitted on the supporting shaft 10.

The fitting portion 15 is formed with a notch 15*a* opened to a downstream direction, i.e., opposite side of the photosensitive drum side, so that the fitting portion 15 has a C-shaped cross section. The separating claw 8 is attached to the supporting shaft 10 by placing the fitting portion 15 over the guide member supporting portion 11 through the notch 15*a* from the forward side, i.e., from the photosensitive drum side, as indicated by an arrow I in FIG. 2, and sliding the fitting portion 15 toward the E-ring 12 as indicated by an arrow II.

The fitting portion 15 is made to have a bore diameter larger than the diameter of the supporting shaft 10 so as to be pivotable about the supporting shaft 10.

Further, the center of gravity of the separating claw 8 is set to be in the lever portion 14 rather than the axis of the fitting portion 15. Accordingly, it is natural that the separating claw 8 pivots in a counterclockwise direction, in other words, in such a direction to turn the tip of the separating claw 8 upward, due to an unbalanced weight thereof.

The guide member 9 comprises a base plate 16 having a flat surface corresponding to the cut surface 11*a* of the guide member supporting portion 11, a guide portion 17 formed on the underside of the base plate 16 for guiding transfer paper, and an arcuate projection 18 formed at an intermediate portion on the flat surface of the base plate 16. The base plate 16 and the arcuate projection 18 constitute a fitting portion 19 having a cross section corresponding to that of the guide member supporting portion 11.

The fitting portion 19 has the size of the cross section slightly smaller than that of the guide member supporting portion 11. After the separating claw 8 is attached to the supporting shaft 10, the guide member 9 is attached to the supporting shaft 10 by resiliently fitting the fitting portion 19 on the guide member supporting portion 11.

Moreover, in order to facilitate the fitting of the fitting portion 19 on the guide member supporting portion 11, an end portion of the arcuate projection 18 is bent outwardly so as to form a bent portion 18*a*.

When the fitting portion 19 is fitted on the guide member supporting portion 11, the guide member 9 automatically comes into a position fixedly determined with respect to the axial, circumferential, and radial directions of the supporting shaft 10.

Also, the attachment of the guide member 9 on the supporting shaft 10 holds the separating claw 8 in the axially fixed position between the E-ring and the guide member 9.

Further, the guide member 9 is integrally provided with a claw holding portion 20 on a side of a rear portion of the base plate 16. The claw holding portion 20 has an L-shape. A stem portion of the L-shaped claw holding portion 20 is directed upward. When the separating claw 8 and the guide member 9 are supported on the supporting shaft 10 as described above, the claw holding portion 20 comes into contact with the underside of the lever portion 14 of the separating claw 8 as shown in FIGS. 3 and 4.

Figure 3:
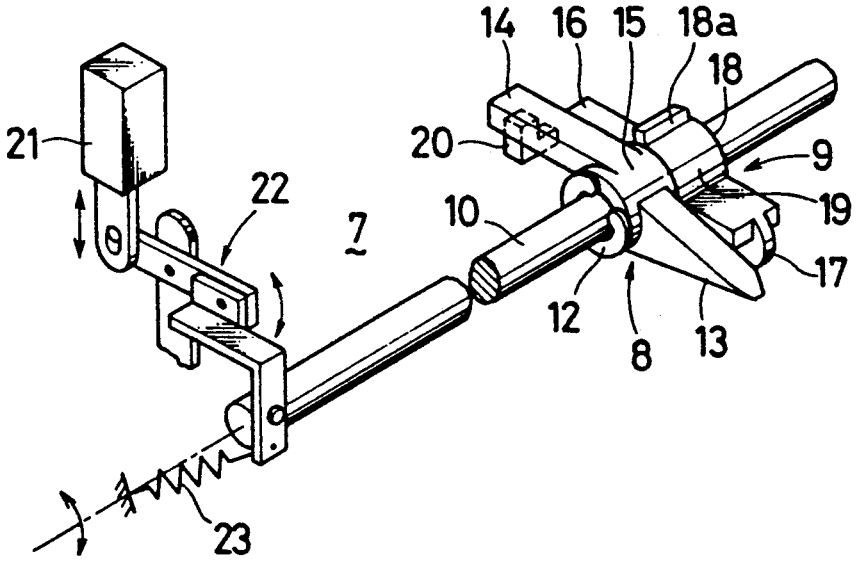
FIG. 3 is a perspective view showing the assembled transfer paper separating device.
Figure 4:
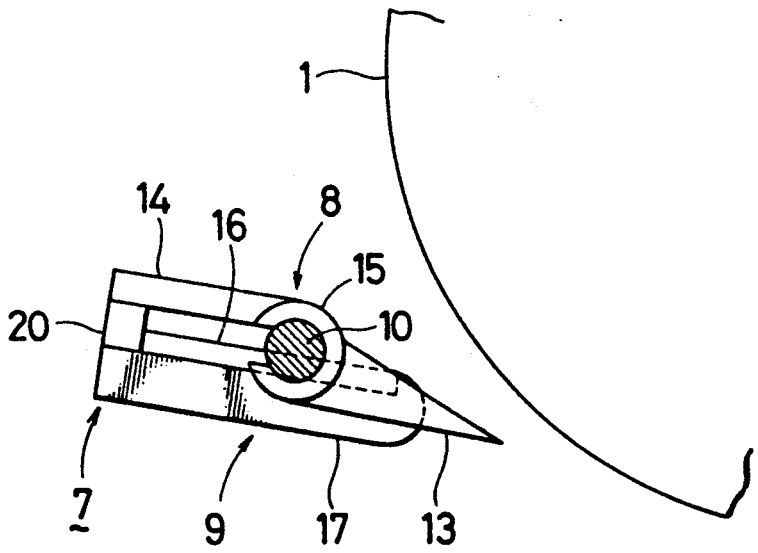
FIG. 4 is a diagram enlargedly showing a state of the transfer paper separating device where a separating claw is positioned away from a surface of a photosensitive drum.

A guide member pivoting mechanism, as shown in FIG. 3, is provided on one or both ends of the supporting shaft 10.

The guide member pivoting mechanism comprises a solenoid 21 as driving means, a link transmission mechanism 22 for transmitting the pulling force of the solenoid 21 to the supporting shaft 10 to pivot the supporting shaft 10 in a specific direction, and a spring 23.

Now, there will be described operations of the transfer paper separating device thus constructed.

The solenoid 21 is energized only when transfer paper is required to be separated. Specifically, for example, when feeding of transfer paper to the photosensitive drum 1 is started, a sensor detects rotation of a register roller or movement of the transfer paper toward the transfer charger 2. In accordance with a detection signal from the sensor, the solenoid 21 is energized.

In a state where the solenoid 21 is not energized, the claw holding portion 20 of the guide member 9 comes into contact with the underside of the lever portion 14 of the separating claw 8, keeping the separating claw 8 from pivoting. Thus, the separating claw 8 stays in a position with the tip of the claw portion 13 being away from the surface of the photosensitive drum 1 (hereinafter referred to as an inoperative position.)

Figure 5:
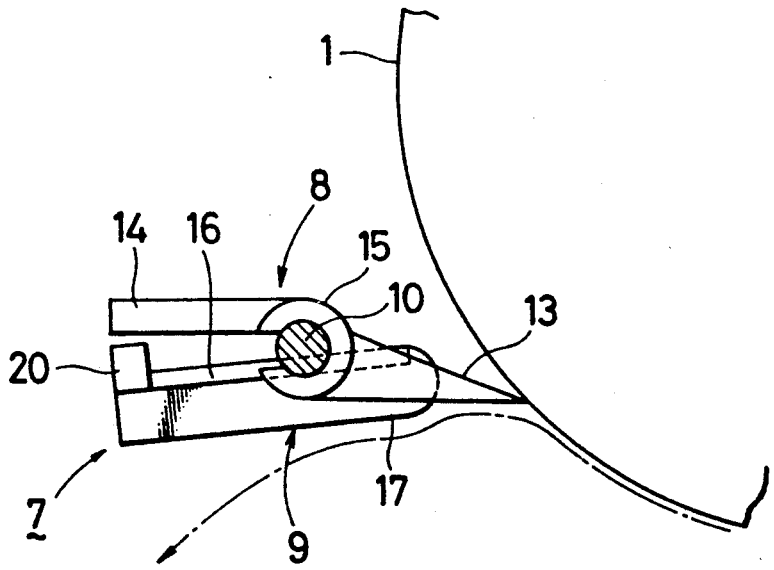
FIG. 5 is a diagram enlargedly showing another state where the separating claw is in contact with the drum surface.

Next, when the solenoid 21 is energized, the supporting shaft 10 is rotated from the inoperative position as shown in FIG. 4 in the counterclockwise direction by a specified amount, so that the guide member 9 pivots in the counterclockwise direction as shown in FIG. 5. Consequently, the claw holding portion 20 departs from the lever portion 14 of the separating claw 8.

This causes the separating claw 8 to naturally pivot in the counterclockwise direction because the separating claw 8 is no longer held in the inoperative position by the claw holding portion 20. Thereby, the tip of the claw portion 13 comes into contact with the surface of the photosensitive drum 1. In this manner, the separating claw 8 is automatically set in an operative position where the transfer paper is appropriately separated.

Thereafter, when the separation of transfer paper is no longer required, the solenoid 21 is stopped energizing. Then, the guide member 9 and the supporting shaft 10 are returned to the respective original positions by the biasing force of the spring 23. Accordingly, the separating claw 8 is pivoted in the clockwise direction and held in the inoperative position as shown in FIG. 4 by the claw holding portion 20.

When the separating claw 8 is replaced because of worn tip thereof, the separating claw 8 and the guide member 9 are detached from the supporting shaft 10 in the order reverse of the attaching order. First of all, the guide member 9 is detached from the guide member supporting portion 11 of the supporting shaft 10 by pulling out in a radial direction. Then, the separating claw 8 is slid to the supporting portion 11 and pulled therefrom similarly to the guide member 9. A new separating claw 8 can be attached to the supporting shaft 10 in the aforementioned attaching order.

As described above, the replacement of the separating claw 8 can be easily accomplished only by detaching the guide member 9 from the supporting shaft 10, and sliding the old separating claw 8 in an axial direction of the supporting shaft 10 and detaching it, and attaching a new separating claw 8 to the supporting shaft 10 and sliding it, and attaching the guide member 9 to the supporting shaft 10.

In the above embodiment, the guide member 9 is made to be pivotable between the operative position and the inoperative position by rotating the supporting shaft 10 through the use of the guide member pivoting mechanism. However, it may be appropriate that the guide member pivoting mechanism directly actuate the guide member 9 to pivot between the two positions.

The guide member pivoting mechanism shown in the above embodiment can be replaced with various other mechanisms. For example, the supporting shaft 10 or the guide member 9 may be provided with a lever which is to be directly driven by a solenoid so as to pivot the guide member 9. When the solenoid is not energized, the guide member 9 is returned to its original position by the biasing force of a spring connected to the supporting shaft 10.

Further, it may be appropriate that a motor or other means be used as driving means instead of the solenoid 21.

In the above embodiment, besides serving as guide means for guiding transfer paper, the guide member 9 serves as pivoting means for pivoting the separating claw 8 between the operative position and the inoperative position. However, it may be suitable that the separating claw 8 be directly driven by a solenoid or other driving means so as to pivot between the operative position and the inoperative position, irrespective of the guide member 9. Furthermore, it may be appropriate to employ such a construction as to make a separating claw 8 in contact with the surface of the photosensitive drum 1.

In the above embodiment, in order to fix the guide member 9 to the supporting shaft 10 with respect to the axial, circumferential, and radial directions of the supporting shaft 10, the guide member supporting portion 11 of the supporting shaft 10 is formed so as to have the D-shaped cross section and the fitting portion 19 of the guide member 9 is resiliently tightly fitted on the guide member supporting portion 11. However, the following modification may be also appropriate: A guide member supporting portion is formed so as to have a rectangular cross section; A guide member is formed so as to have a fitting portion in a U-shaped cross section; The U-shaped fitting portion is fitted on the rectangular guide member supporting portion; The guide member is positioned with respect to axial and circumferential directions of the supporting shaft and then fixedly attached to the supporting shaft by a screw or other fastening means.

Moreover, it may be appropriate that a separating claw and a guide member may be attached to the supporting shaft by axially sliding them from an end of the supporting shaft.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A transfer paper separating device for use in an image forming apparatus having an image transfer means and a photosensitive drum, comprising:

a common supporting shaft;

a separating claw for separating transfer paper passed through said image transfer means from a surface of said photosensitive drum;

a guide member for guiding said transfer paper separated by said separating claw to a predetermined path;

guide member pivoting means which includes said common supporting shaft for pivoting said guide member between a first position and a second position;

said separating claw and said guide member being mounted on said common supporting shaft and being juxtaposed to each other in an axial direction of said common supporting shaft;

said separating claw being pivotable about said common supporting shaft between an operative position in which a tip of said separating claw is in contact with said surface of said photosensitive drum and an inoperative position in which said tip of said separating claw is away from said surface of said photosensitive drum, the center of gravity of said separating claw being offset from said common supporting shaft so as to pivot to said operative position without being controlled; and controlling means on said guide member for preventing said separating claw from pivoting to said operative position when said guide member is in said first position and allowing said separating claw to pivot to said operative position when said guide member is in said second position.

2. A transfer paper separating device as defined in claim 1 wherein said common supporting shaft is rotatable about an axis thereof and said guide member is attached to said supporting shaft in such a manner as to pivot with rotation of said supporting shaft, said guide member pivoting means pivoting said guide member between said first position and said second position by rotating said common supporting shaft.

3. A transfer paper separating device for use in an image forming apparatus having an image tranfer means and a photosensitive drum, comprising:

a common supporting shaft;

a separating claw for separating transfer paper passed through said image transfer means from a surface of said photosensitive drum, said separating claw having a fitting portion formed with an opening for enabling said separating claw to be removably attached to said common supporting shaft in a radial direction of said common supporting shaft;

a guide member for guiding said transfer paper separated by said separating claw to a predetermined path, said guide member having a fitting portion formed with an opening for enabling said guide member to be removably attached to said common supporting shaft in a radial direction of said common supporting shaft;

fixing means for keeping said guide member from moving in an axial direction on said common supporting shaft; and said separating claw being mounted on said common supporting shaft and being in contact with said guide member so as to keep said separating claw from moving in one axial direction on said common supporting shaft.

4. A transfer paper separating device as defined in claim 3 further comprising a fixing member attached to said common supporting shaft for keeping said separating claw from moving in the other opposite axial direction on said common supporting shaft.

5. A transfer paper separating device as defined in claim 4 wherein said fitting portion of said separating claw is slidable on said common supporting shaft, whereby said separating claw is mounted on said common supporting shaft and slid to said fixing member, said guide member being attached to said common supporting shaft by said fitting portion of said guide member and being kept from moving in the axial direction of said common supporting shaft by said fixing means.

6. A transfer paper separating device as defined in claim 5 wherein said fixing means includes a guide member supporting portion formed in said common supporting shaft for supporting said guide member, said guide member supporting portion having a D-shaped cross section, said fitting portion of said guide member being resiliently and tightly fittable on said guide member supporting portion.

7. A transfer paper separating device as defined in claim 4 wherein said fixing means includes a guide member supporting portion formed in said common supporting shaft for supporting said guide member, said guide member supporting portion having a D-shaped cross section, said fitting portion of said guide member being resiliently and tightly fittable on said guide member supporting portion.

8. A transfer paper separating device as defined in claim 7 wherein said fitting portion of said guide member includes a flat portion and an arcuate portion, said arcuate portion having an end being formed with a bent portion at said end.

9. A transfer paper separating device as defined in claim 3 further comprising guide member pivoting means for pivoting said common supporting shaft such that said common supporting shaft pivots said guide member between a first position and a second position, said separating claw being pivotable about said common supporting shaft between an operative position in which a tip of said separating claw is in contact with the surface of said photosensitive drum and an inoperative position in which said tip of said separating claw is away from said surface of said photosensitive drum, the center of gravity of said separating claw being offset from said common supporting shaft so as to pivot to said operative position without being controlled, and controlling means on said guide member for preventing said separating claw from pivoting to said operative position when said guide member is in said first position and allowing said separating claw to pivot to said operative position when said guide member is in said second position.

* * * * *